US005741031A

United States Patent [19]

Bauman et al.

[11] Patent Number: 5,741,031

[45] Date of Patent: Apr. 21, 1998

[54] CONCEALED WINDOW LOCK WITH DETACHABLE HANDLE AND ESCUTCHEON

[75] Inventors: Leonard P. Bauman, Byron; Eric P. Heim, Owatonna; Peter E. Braun, Faribault; Joseph P. Landherr, Rose Creek, all of Minn.

[73] Assignee: Truth Hardware Corporation, Owatonna, Minn.

[21] Appl. No.: 617,060

[22] Filed: Mar. 18, 1996

[51] Int. Cl.[6] ..... E05C 1/06

[52] U.S. Cl. ..... 292/139; 292/26; 292/DIG. 7; 292/DIG. 20

[58] Field of Search ..... 292/26, 35, 36, 292/97, 139, 158, 161, 241, 196, DIG. 7, DIG. 20, DIG. 30, DIG. 47

[56] References Cited

U.S. PATENT DOCUMENTS

| | | | |
|---|---|---|---|
| 960,386 | 6/1910 | Obert | 292/139 |
| 1,621,174 | 3/1927 | Schlage | 292/348 |
| 2,876,515 | 3/1959 | Saffer | 292/348 |
| 3,999,789 | 12/1976 | Mavrits | 292/36 |
| 4,674,777 | 6/1987 | Guelck | 292/DIG. 20 |
| 5,219,195 | 6/1993 | Lug | 292/36 |
| 5,248,175 | 9/1993 | Burns | 292/DIG. 31 |
| 5,318,333 | 6/1994 | Dreifert | 292/36 |

FOREIGN PATENT DOCUMENTS

| | | | |
|---|---|---|---|
| 9427013 | 11/1994 | WIPO | 292/DIG. 31 |

*Primary Examiner*—Rodney M. Lindsey
*Assistant Examiner*—Gary Estremsky
*Attorney, Agent, or Firm*—Wood, Phillips, VanSanten, Clark & Mortimer

[57] ABSTRACT

A window lock actuator including a link assembly rotatably mounted on the window jamb, the link assembly operably securable to control movement of a cam into and out of engagement with a keeper for locking a sash to a window jamb. A handle is detachably secured to the link assembly for rotation therewith, and has two legs cradling the link assembly when the handle is secured thereto. Two tabs on the link assembly and two recesses on opposite inner surfaces of the legs engage when the handle is secured to the link assembly. An escutcheon has a spring secured on one side, which spring is biased outwardly against one side of a jamb cavity to frictionally secure the escutcheon in the cavity.

5 Claims, 8 Drawing Sheets

CONCEALED WINDOW LOCK WITH DETACHABLE HANDLE AND ESCUTCHEON

BACKGROUND OF THE INVENTION

1. Technical Field

The present invention is directed toward a window lock, and more particularly toward a concealed window lock having a easily removable handle and escutcheon.

2. Background Art

Window locks are old in the art, and generally include a catch with a handle actuator affixed to a window frame which interacts with a keeper on a corresponding section of the movable window sash to securely hold the sash tightly against the frame. Also known in the art are devices for sequential multi-point lock-up of the movable window sash with the window frame. These latter devices generally include a handle actuator interacting with a keeper at one point on a window frame and sash respectively, which causes a second lock to engage a second keeper at a spaced location.

Commonly owned U.S. Pat. No. 4,991,886 to Nolte et al. U.S. Pat. No. 5,087,087 to Vetter et al, and U.S. Pat. No. 5,118,145 to Tucker, all of which are hereby incorporated by reference, disclose such multi-point window locks. These devices use a tie bar connecting two spaced apart cam members or rollers which interact with keepers affixed to a window sash to establish a locked condition of the window. The movement of a handle actuator from its unlocked position causes the adjacent roller on the tie bar to connect with the planar portion of an associated ramped keeper. Continued movement of the handle actuator causes the tie bar to also move the second roller into the planar section of the second associated ramped keeper.

However, with many window locks, the hardware of the lock projects significantly, tending to detract from the beauty of the wood or vinyl wrapped window and/or intrude into the desired visual opening through the window.

Further, with many prior art window locks, the handle and escutcheon are either permanently attached, or attached by screws or some other means such that they are difficult to remove. Using screws to attach the escutcheon to the window jamb leaves holes in the jamb which detract from both its aesthetics and its strength. Such prior art window locks make it difficult to paint or stain the window, since the painter has to work around or cover up the hardware. Further, window hardware is often incorporated into assembled window units in a factory and the window units are thereafter shipped to a construction site. In such cases, there is a risk that the handles of such prior art locks may be broken off or otherwise disabled during shipping, and also a risk that the handle may scratch, gouge or otherwise damage adjacent window units on the transport vehicle. Further, shipping efficiency and costs can be adversely impacted by the steps required to minimize those risks.

Further, in those prior art locks in which screws are used to secure the lock to the frame, upgrades or replacement of components can be difficult unless exact duplicates with identically located screw holes are used. Given the long life of windows, and changing designs over such long periods such that the original designs may not be available much later when replacement is desired, this can be a significant drawback. Further, since new designs might very well use differently spaced screws, the frame could end up with multiple screw holes, reducing the strength of the frame and, if the new screw holes are close to old holes, making it difficult to securely attach the new components in the desired position.

Still further, prior art window locks have encountered problems with air, bug and light infiltration through the window lock when the sash is secured against the window frame. Locking of necessity requires some openings around the sides of the window frame, and thus window locks require not only a structure which functions properly but also a structure which minimizes infiltration of air, etc. around the structure.

The present invention is directed toward overcoming one or more of the problems discussed above.

SUMMARY OF THE INVENTION

In one aspect of the present invention, a window lock actuator is provided for selectively locking a window sash closed against a window jamb by selectively engaging a first member secured to the jamb with a second member secured to the sash when the sash is substantially closed against the jamb. The window lock actuator includes a link assembly rotatably mounted on the window jamb, the link assembly operably securable to the first member to control movement of the first member into and out of engagement with the second member, and a handle detachably secured to the link assembly for rotation therewith.

In preferred forms of this aspect of the invention, two legs define a fork at a distal end of the handle, and the two legs of the handle cradling the link assembly when the handle is secured thereto. Two tabs on the link assembly and two recesses on opposite inner surfaces of the legs engage when the handle is secured to the link assembly.

In another aspect of the present invention, the window lock actuator includes an escutcheon detachably secured in a cavity defined in the window jamb.

In a preferred form of this aspect of the invention, a spring is secured on one side of the escutcheon and is biased outwardly against one side of the jamb cavity to frictionally secure the escutcheon between the opposite side and the one side of the cavity.

In another preferred form of this aspect of the invention, a light guard is detachably secured to an edge of the first member to block most of the light entering through the window lock.

An object of the invention is to provide a window lock which does not interfere with or detract from the beauty of the window.

Another object of the invention is to provide a window lock which will not interfere with maintenance of the window unit (such as painting), nor will it adversely effect the strength of the window unit over time.

Still another object of the invention is to provide a window lock which may be easily assembled and transported with window units, without risk of damaging any components and without adversely effecting the efficiency or costs of such shipping.

Yet another object of the present invention is to provide a window lock which minimizes infiltration of air, etc. around the structure.

DETAILED DESCRIPTION OF THE PREFERRED EMBODIMENT

Figure 1:
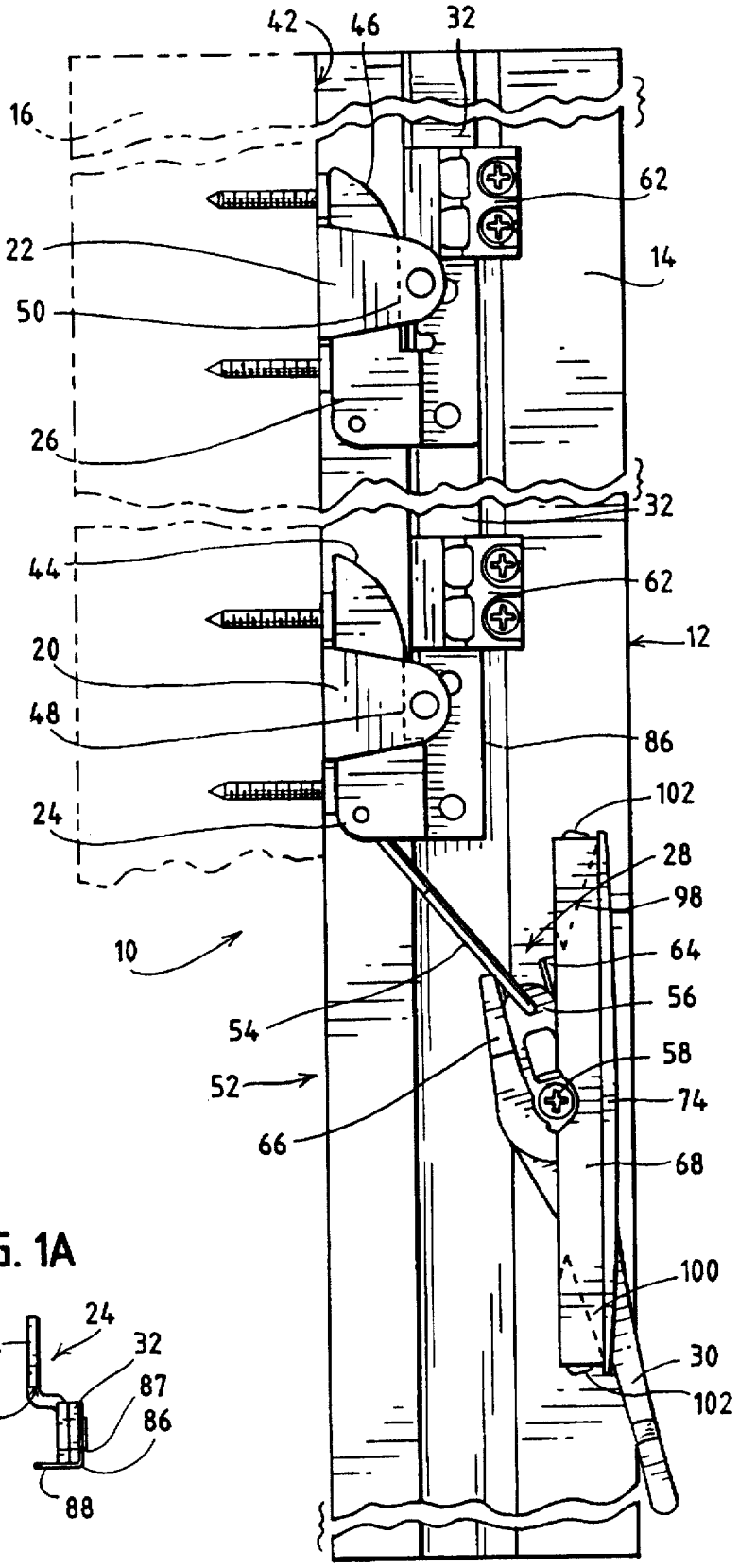
FIG. 1 is a partially broken away view of a window embodying the window lock of the present invention, with the window lock in the closed position.
Figure 1A:
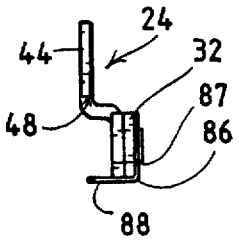
FIG. 1A is a view of the tie bar and bottom cam as seen from the top in FIG. 1.
Figure 2:
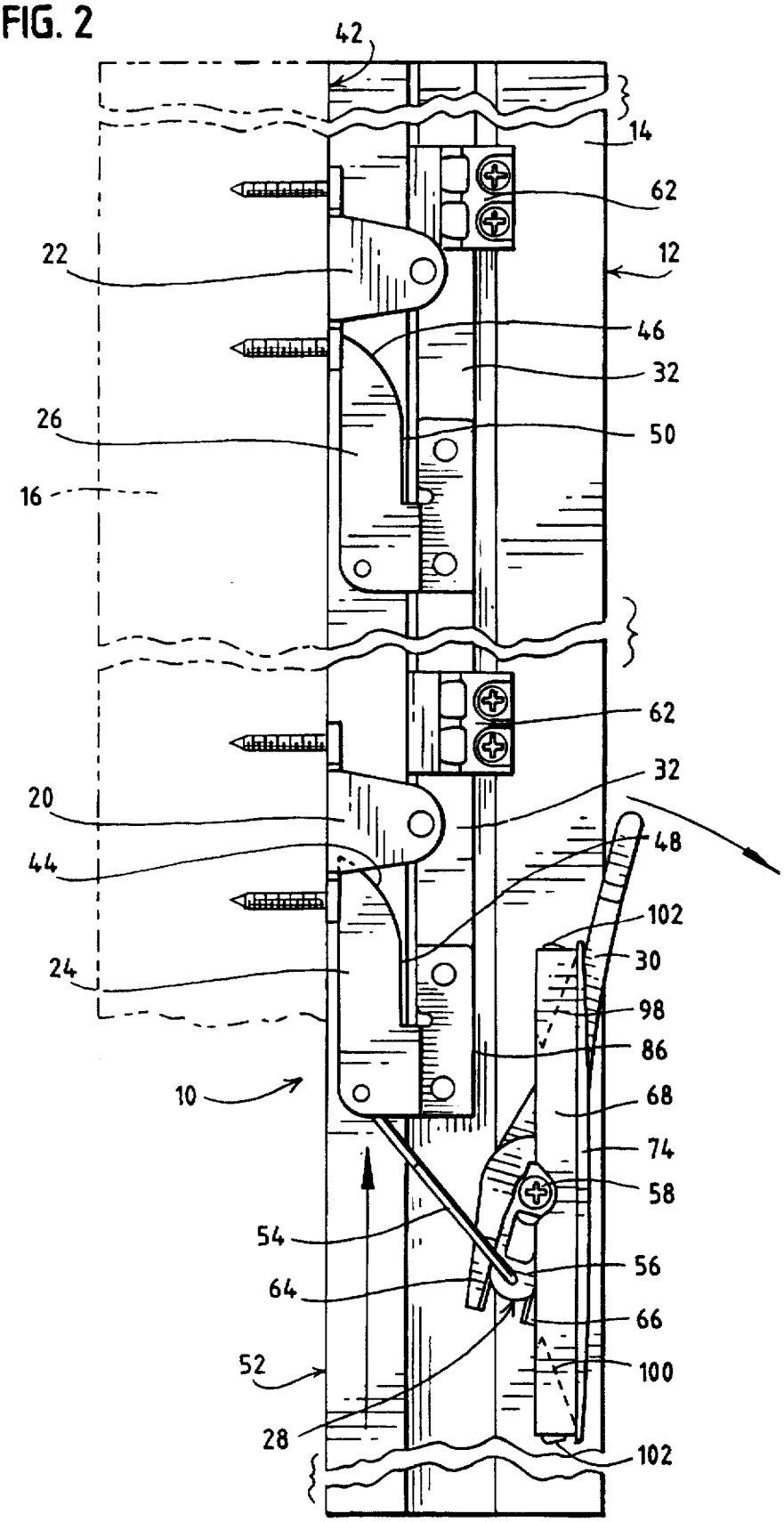
FIG. 2 is a view similar to FIG. 1 showing the window lock in the open position.

Referring to FIGS. 1 or 2, a multi-point window lock generally indicated by 10 is mounted into an interior face 12 of a window jamb or frame 14, with the only room-visible part thereof being an escutcheon 68 and a handle 30. A window sash generally indicated at 16 is in a preferred embodiment part of a casement window (not shown) which is pivotally mounted to the jamb 14 in a suitable manner, as by hinges secured to opposite sides of the jamb 14 and sash 16. The mounting of such a window by hinges is well known in the art.

It should be understood that though the description herein generally refers to casement windows, the present invention could also be used with a variety of different window types, including awning windows and French windows, as well as windows made of a variety of different materials, such as wood or vinyl wrap windows. Specifically, the window lock 10 of the present invention may be advantageously used to securely hold a window sash 16 tightly against a window jamb 14 to prevent light, air and bug infiltration.

The multi-point lock 10, which will hereafter be described, is only one example of a type of lock which would benefit from incorporating the present invention. Though the particular lock structure such as disclosed herein may be advantageously used with the present invention, once a full understanding of the present invention is obtained, it should be recognized that still other lock configurations could also be advantageously used with the present invention.

Referring to FIGS. 1 or 2, the window lock 10 is comprised of keepers 20, 22, cams 24, 26, a link assembly shown generally at 28, and a handle 30. A tie bar 32 links the two cams 24, 26 for facilitating sequential lock-up in tandem. In one preferred form, an L-shaped bracket 86 is secured to the tie bar 32 and cam 24 as shown in FIG. 1 A, and provides, inter alia, a rigid connection therebetween. L-shaped bracket 86 includes two perpendicular sides 87 and 88. Side 87 is secured to the tie bar 32 and cam 24, while side 88 extends into the keeper opening in the jamb 14 and helps block the light entering through the keeper opening and exiting between the handle 30 and escutcheon 68. The cams 24, 26 have interior ramped portions 44, 46 and planar portions 48, 50, as is known in the art, to facilitate locking in cases where the sash 16 is slightly out of alignment with the jamb 14. Guides 62 are suitably secured relative to the jamb 14 allowing axial movement of the tie bar 32 and attached cams 24, 26.

Although not depicted in any of the figures, guides 62 preferably include a locating feature to hold them in the proper position before assembly. The locating feature comprises a detent bump on the inside of the guide 62 and a corresponding detent hole in the tie bar 32 (also not shown). Engagement of the detent bump on the inside of the guide 62 and the corresponding detent hole in the tie bar 32 holds the tie bar in place before assembly, but also permits movement of the tie bar 32 when the window lock 10 is operated.

Figure 6:
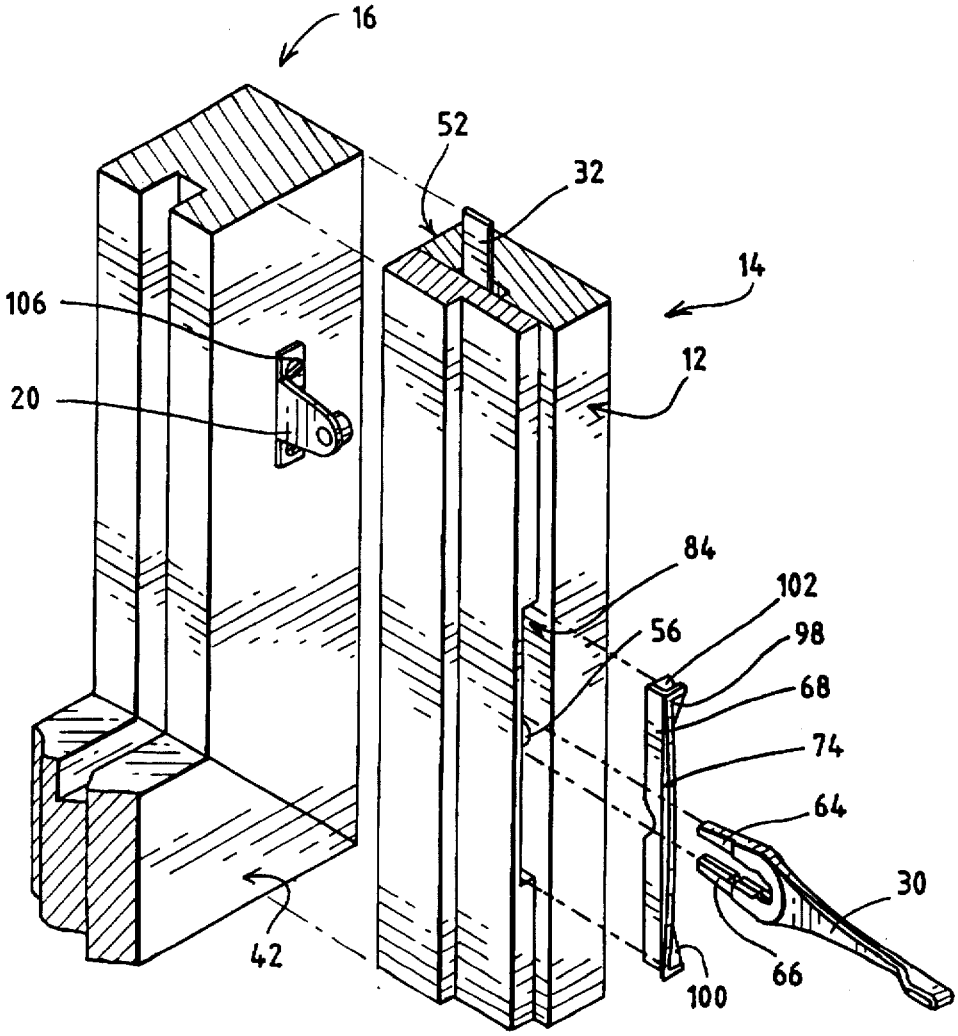
FIG. 6 is an exploded perspective view of a window jamb and sash embodying the window lock of the present invention.

Keepers 20 and 22 are secured at spaced points along one side of the sash 16 and, as is known in the art, in a preferred form have rollers (see roller 106 in FIG. 6) which engage the cams 24, 26 during locking. Specifically, the rollers engage first the ramped portions 4—4, 46 and then the planar portions 48, 50 of the cams 24, 26 as the tie bar 32 moves axially (up in FIGS. 1 and 2) for locking, securely pulling the interior side 42 of sash 16 against an outer side 52 of the jamb 14.

Of course, the keepers could instead be secured to the tie bar 32 and the cams secured to the sash 16.

Spacing of the keepers 20, 22 and the cams 24, 26 from one another is selected to provide the desired sequence of locking, as is known in the art. Delayed lock-up may also be provided if desired, as is also known. Further, while only two keepers and cams are shown in the embodiment shown in FIGS. I and 2, any number of keepers and cams may be used without departing from the spirit and scope of the present invention.

For example, a single locking point window lock utilizing one cam 24 and one keeper 20 could be advantageously used with the present invention. The cam 24 could be located at a desired locking point along the length of the tie bar 32. This would allow the customer to keep a common location of the escutcheon 68 and handle 30 across a product line, while positioning the keeper 20 at the center of sash 16 on succeedingly taller windows.

A link assembly 28 providing manual control of the movement of the tie bar 32 includes a wire link 54 and a detach link 56. The detach link 56 is mounted in the jamb 14 with screw 58 and is rotatable around a snap-in bearing 60 (see FIG. 4A) which limits horizontal play of the link 56. The wire link 54 is pivotally coupled between the first cam 24 and the detach link 56, whereby pivoting of the detach link 56 about the bearing 60 acts through the wire link 54 to move the cams 24, 26 and tie bar 32 for operation of the locking structure shown.

The handle 30 is suitably secured to the detach link 56 as described in greater detail below, so that rotation of the handle 30 causes the detach link 56 to also rotate and the connected wire link 54 is thereby moved to move the tie bar 32 and connected cams 24, 26.

Operation of the above-described form of a preferred embodiment of the window lock 10 is thus as follows.

In the locked position shown in FIG. 1, the handle 30 is pivoted down, causing the link assembly 28 to position the tie bar 32 and connected cams 24, 26 up in an overlapping engagement with the keepers 20, 22 on the window sash 16. The overlapping engagement of the keepers 20, 22 and cams 24, 26 prevent the sash 16 from being moved away from the jamb 14, such as is known in the art. Further, as is seen in FIG. 1, the overcenter orientation of the wire link 54 relative to the pivot point of the detach link 56 in the locked position prevents "back driving" so as to make picking of the lock from the outside of the window difficult (that is, any attempt to move the tie bar 32 down from this position would require that the handle 30 be pivoted beyond its limit position). Further, when moving the handle 30 to the locking position, the transition of the wire link 54 to an overcenter position provides the homeowner with the feeling of a "sip" or "pop" to signal that the sash 16 is locked and tightly secure against the jamb 14.

By pivoting the handle 30 upward to the unlocked position shown in FIG. 2, the link assembly 28 is shifted to pull the cams 24, 26 down clear of the keepers 20, 22, thereby releasing the sash 16 to permit it to be moved (to the left in FIG. 2) away from the jamb 14.

Figure 3:
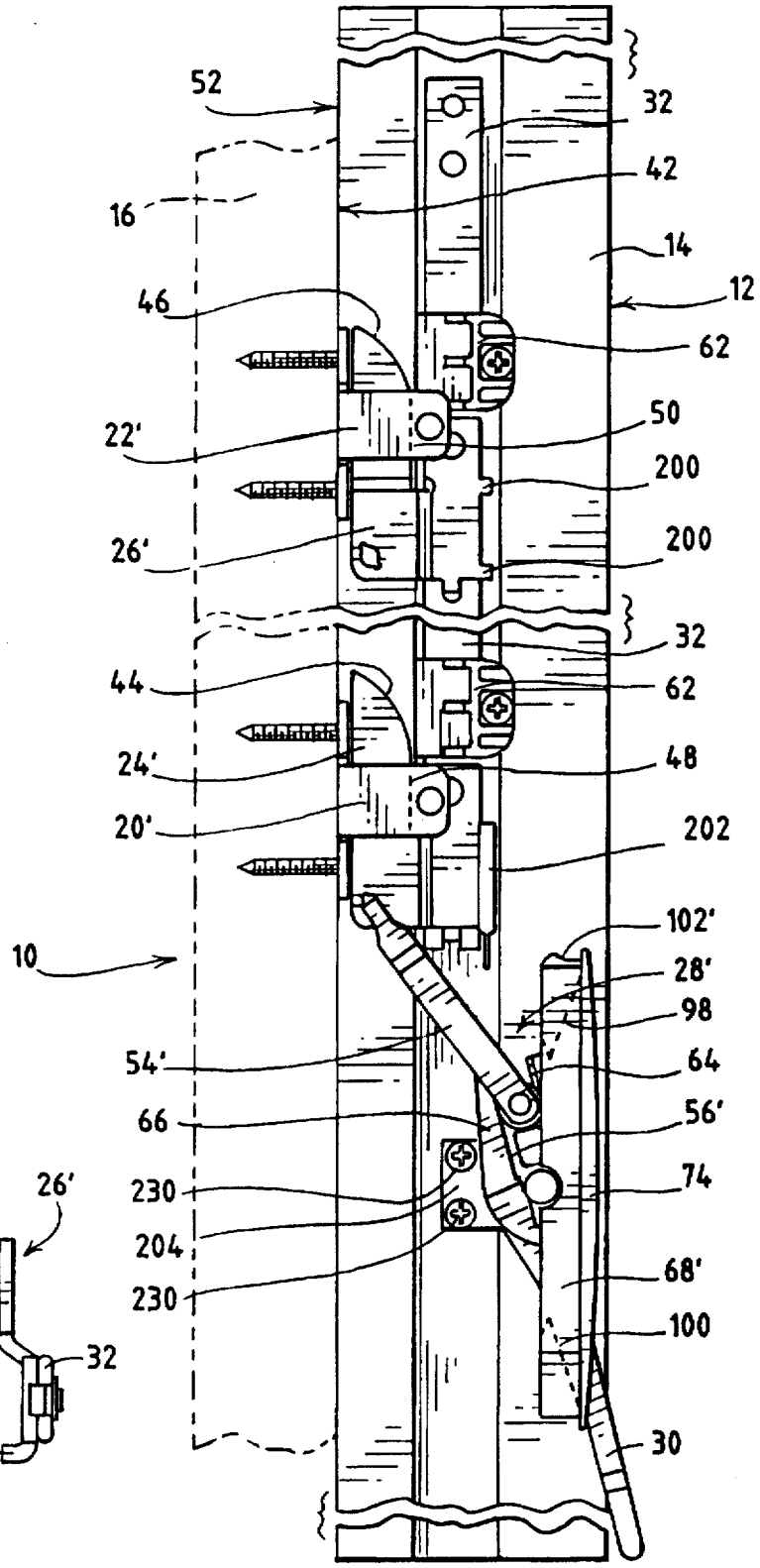
FIG. 3 is a partially broken away view of a window according to one embodiment of the present invention, with the window lock in the closed position.

FIG. 3 depicts another preferred form of the present invention. FIG. 3 is similar to and operates in the same manner as previously described FIGS. 1 and 2. Like elements in FIG. 3 and 1-2 are given the same reference numbers, while those elements which have undergone a design variation from FIGS. 1–2 to FIG. 3 are indicated with a "prime".

Figure 3A:
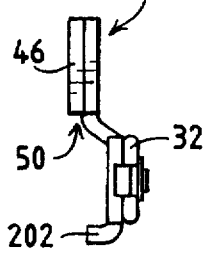
FIG. 3A is a view of the tie bar and top cam as seen from the top in FIG. 3.

Cams 24', 26', in FIG. 3, generally include tabs 200 formed on the outer edge thereof, extending generally perpendicular from the surface of the cams 24', 26' as shown in FIG. 3A. Tabs 200 are used to hold the light guard 202 in place. In FIG. 3, the light guard 202 is attached to the cam closest the handle 30 and escutcheon 68', specifically cam 24'.

Figure 11:
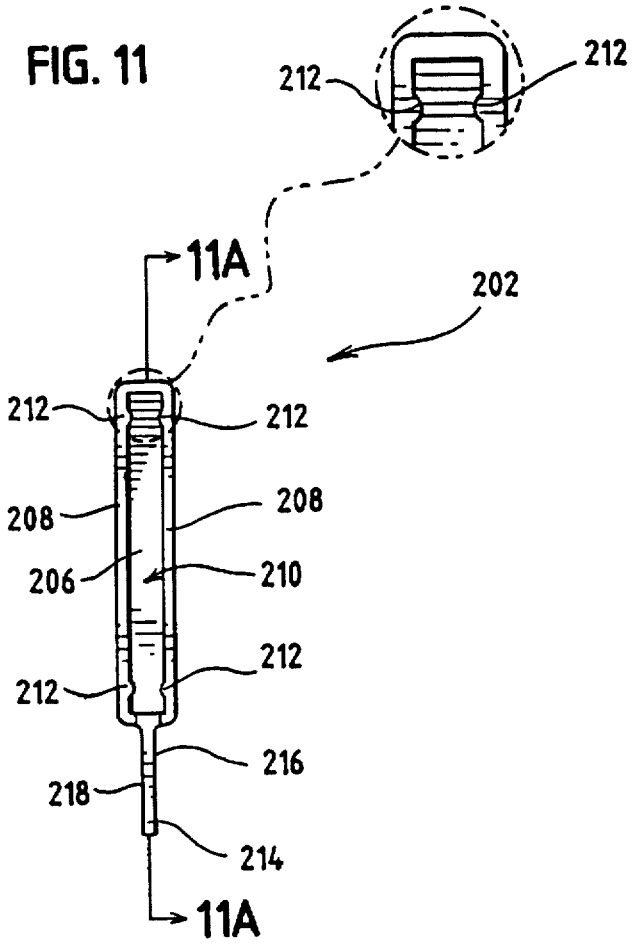
FIG. 11 is a plan view of the light guard from the back side of FIG. 3.
Figure 11A:
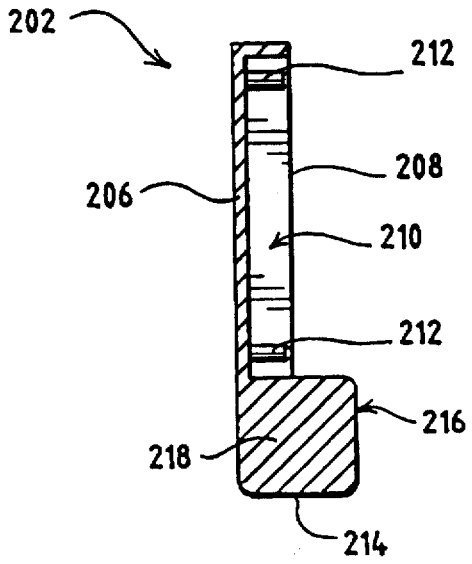
FIG. 11A is a cross-sectional view of the light guard of FIG. 11 taken along line A—A.

As shown in FIGS. 11 and 11 A, the light guard 202 includes a front wall 206 and two sidewalls 208 defining a channel 210 running generally the length of the light guard 202. The inner surface of the sidewalls 208 includes opposing bumps 212 which extend into and are generally perpendicular to the length of the channel 210. The tabs 200 on cam 24' are received in the channel 210 and generally engage bumps 21 2 when the light guard 202 is pressed in place. The light guard 202 is held in place by the slight interference fit between opposing bumps 212 and tabs 200.

While the light guard 202 is shown as only attached to cam 24' in the embodiment shown in FIG. 3, it should be understood that the light guard 202 could also be attached to cam 26' or any of the number of cams which could be used with the present invention.

The light guard 202 includes a fin 214 at a distal end having opposing surfaces 21 6 and 21 8. When the light guard 202 is attached to cam 24', the fin 214 extends into the keeper opening in the jamb 14 and blocks a portion of the light entering through the keeper opening and exiting between the handle 30 and escutcheon 68'.

Again, the above keeper/cam/tie bar combination is generally known in the art. The present invention as described in greater detail below is an improved structure which may be used with the above and other lock structures, particularly those which may be operated by pivoting handles.

Figure 4B:
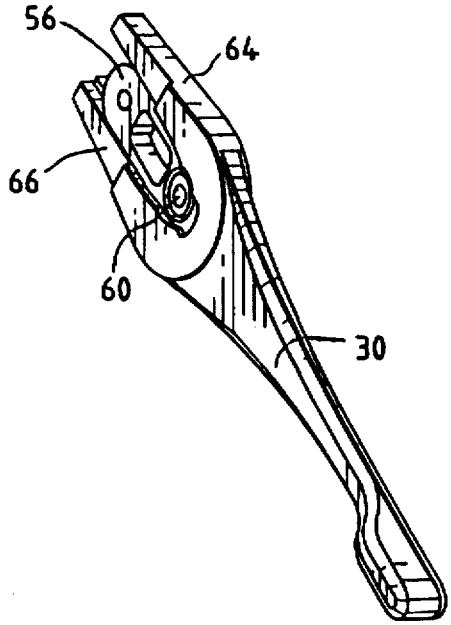
FIG. 4B is a perspective view of the handle and detach link in the secured position.
Figure 4A:
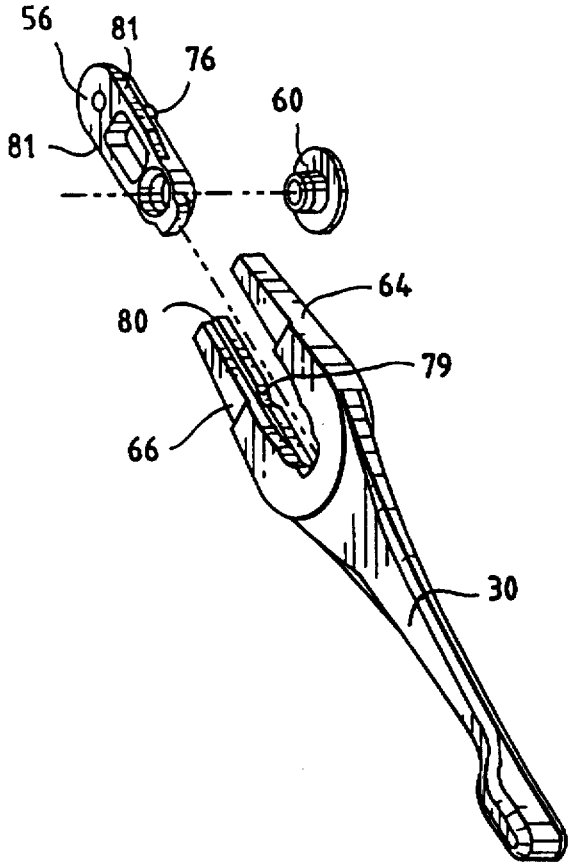
FIG. 4A is an exploded perspective view of the handle and detach link of the window lock of the present invention.
Figure 5:
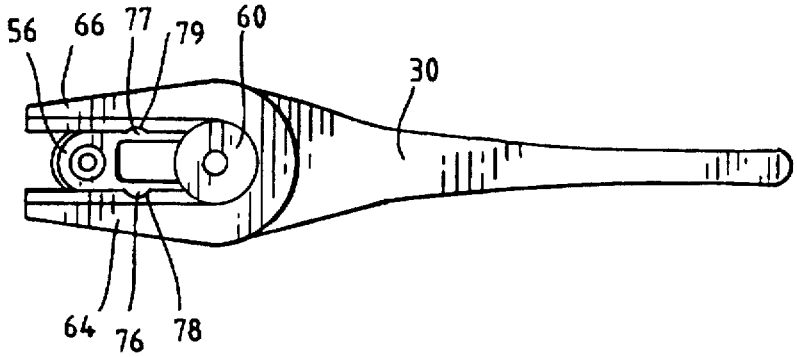
FIG. 5 is a plan view of the handle and detach link from the bottom side of FIG. 4B.

Specifically, in one preferred embodiment shown in FIGS. 4A, 4B and 5, the handle 30 of the present invention includes legs 64, 66 generally forming a fork, which legs 64, 66 cradle the detach link 56 of the link assembly 28. The detach link 56 includes a pair of tabs 76, 77 on opposite sides, which tabs 76, 77 are received in recesses 78, 79 on the handle legs 64, 66 to releasably secure the handle 30 to the detach link 56. Further, the legs 64, 66 preferably each include a longitudinal groove 80 (see FIG. 4A) receiving flanges 81 on opposite sides of the detach link 56 to provide a substantial wobble-free connection between the handle 30 and detach link 56.

This handle 30 and detach link 56 combination thus allow for the handle 30 to be snap fit onto the detach link 56 so as to provide for secure and reliable manual operation of the lock 10 by moving the handle 30. Further, while the handle 30 is securely retained in the assembly during use, it may also be easily removed for maintenance or other purposes by simply axially pulling on the handle 30 off of the detach link 56.

Figure 9A:
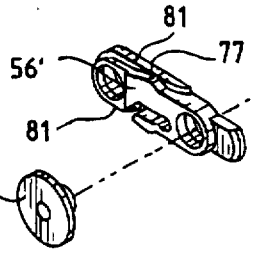
FIG. 9A is an exploded perspective view of the detach link and snap-in bearing according to one embodiment of one aspect of the present invention.
Figure 9B:
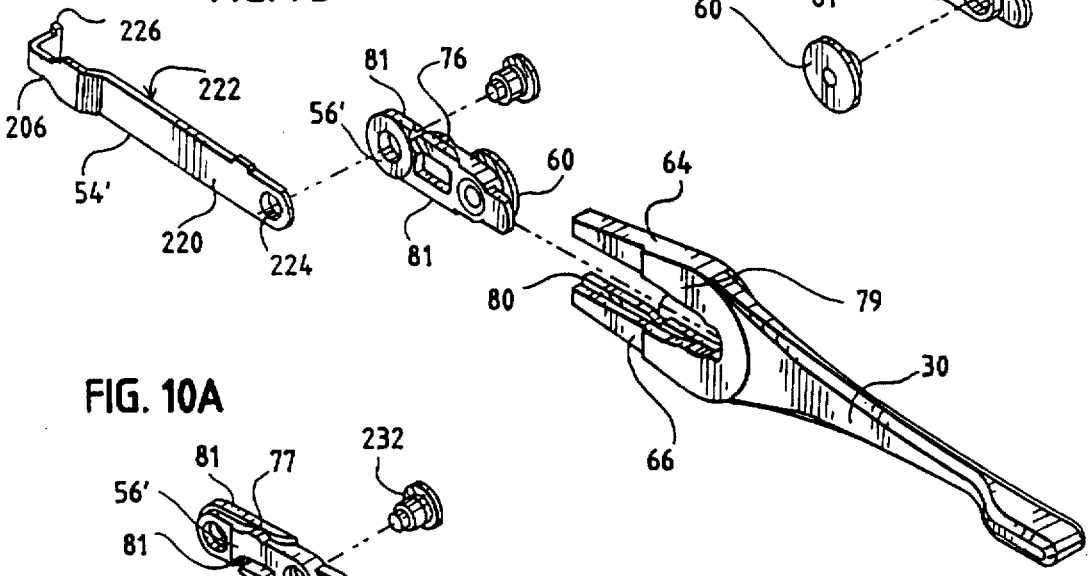
FIG. 9B is an exploded perspective view of the handle, detach link and link according to the FIG. 9A embodiment.

In another preferred embodiment shown in FIGS. 9A and 9B, link 54' has opposing generally flat surfaces 220 and 222 with a bore 224 at one end for rotatably mounting link 54' to detach link 56'. The other end of link 54' includes perpendicular flanges 226 generally forming a "T" for communication with an appropriate receptacle in cam 24' (see FIG. 3). It should be understood that link 54' or wire link 54 could alternatively be attached to the tie bar 32 without departing from the spirit and scope of the present invention.

The handle 30 and detach link 56', shown in FIGS. 9A and 9B, are secured and operate in the same manner as previously described with respect to FIGS. 4A, 4B and 5. Structures similar to detach link 56' and 56 are indicated with like reference numbers. Detach link 56' is rotatable about snap-in bearing 60 and is mounted in the jamb 14 with a screw 58 (not shown).

Figure 10A:
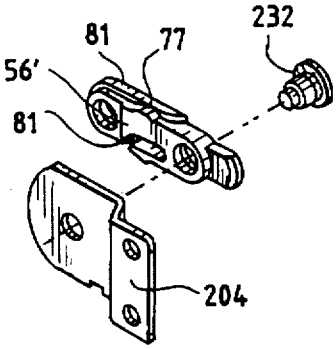
FIG. 10A is an exploded perspective view of the detach link, backplate and snap-in bearing according to another embodiment of one aspect of the present invention.
Figure 10B:
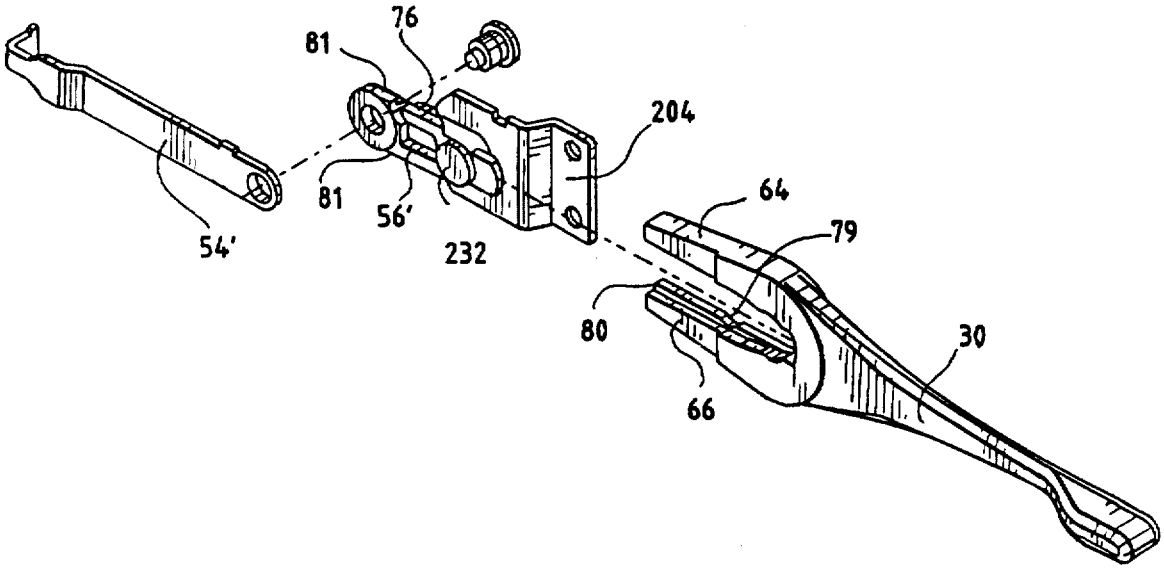
FIG. 10B is an exploded perspective view of the handle, detach link, backplate and link according to the FIG. 10A embodiment.

FIGS. 10A and 10B depict another preferred form of link assembly 28'. The handle 30, detach link 56' and link 54' are the same as shown in FIGS. 9A and 9B, and accordingly are secured and operate in the same manner. Detach link 56' (in FIG. 10A and 10B) is, however rotatably secured to a backplate 204 with rivet 232, and the backplate 204 is mounted in the jamb 14 with screws 230 (see FIG. 3). This embodiment can be advantageously utilized with window assemblies where jamb extensions are used. Jamb extensions cause a seam in the jamb 14 that interferes with the mounting screw 58 of the link assembly 28, 28'.

An escutcheon 68 is attached to the window jamb 14 inside a cavity 84 (see FIG. 6) formed in the window jamb 14. The escutcheon 68 has an inwardly extending side 90 (generally disposed in the cavity 84 when mounted to the jamb 14) and an outwardly extending side 92. Preferably, the escutcheon 68 includes having a flange 74 on its outwardly extending side 92 which overlies the edge of the opening to the cavity 84. The flange 74 provides an aesthetically pleasing appearance by covering the potentially rough edges of the cavity 84 and blocking against light passing between the escutcheon 68 and the jamb 14, and further assists in blocking air, insects and/or other undesirable elements from entering a dwelling between the escutcheon 68 and jamb 14.

The flange 74 also facilitates removal of the escutcheon 68 from the jamb cavity 84 as described further below.

Though the cavity 84 in a preferred embodiment would be positioned near the end of one side of the jamb 14 such as shown in FIGS. 1, 2 and 3, the cavity 84 could also be advantageously provided in different positions along the side of the jamb 14. For example, the cavity 84 could be separate from and in between locking points so as to eliminate a cavity routing all the way through the jamb 14 to further prevent air, light and bug infiltration through the jamb 14 of the window.

At the inner corners of the escutcheon 68 opposite the flange 74 are two triangular shaped members 94, 96 (see FIGS. 7 and 8), which include sidewalls 98, 100 extending from the corners at the outward side 92 to the interior side 90 at an angle. These sidewalls 98, 100 define the two limit positions of the handle 30, and are generally aligned with the position of the handle 30 when in one of the limit positions.

In the preferred embodiment, at least one spring 102 is suitably secured to at least one end of the escutcheon 68 and is biased outwardly therefrom so as to bear against the end of the cavity 84 when the escutcheon is disposed therein, so that the spring 102 frictionally secures the escutcheon 68 in the cavity 84. Two springs 102 can be used as shown in FIGS. 7 and 7A, although it should be understood that only one spring 102 on one side could be used within the present invention (in which case, the spring would bear on one side of the cavity 84 and the escutcheon would directly bear on the other side of the cavity 84.

Figure 7:
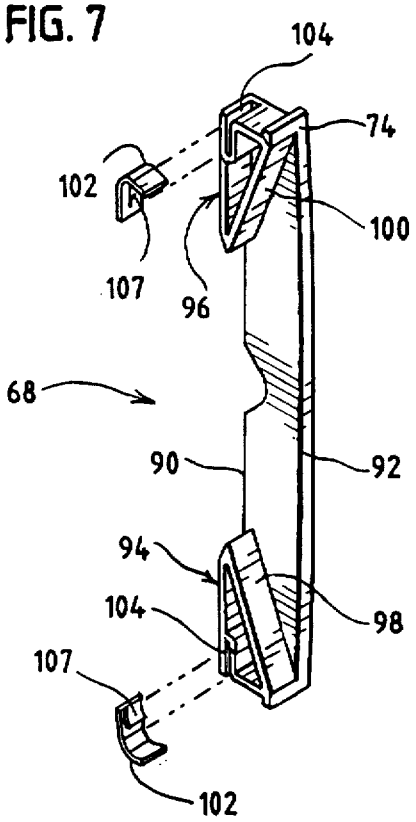
FIG. 7 is an exploded perspective view of an escutcheon and springs according to one embodiment of one aspect of the present invention.
Figure 7A:
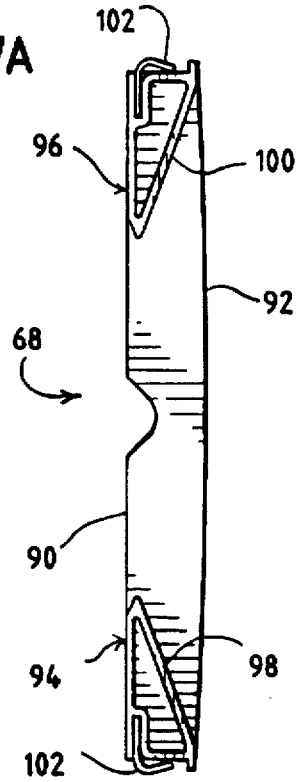
FIG. 7A is a side view of the FIG. 7 embodiment.

In the preferred embodiment shown in FIGS. 7 and 7A, the springs 102 may be simple bent members having one end secured in a slot 104 in the escutcheon 68. A cut spring portion 107 biases upward from the secured spring end, giving that end an effective thickness greater than the slot 104 and thereby resulting in a frictional binding of the spring 102 in the slot 104. The curved other end of each spring 102 press against the sides of the cavity 84 to frictionally securing the escutcheon 68 inside the cavity 84. Removing the escutcheon 68 from the jamb 14 may thus be easily accomplished (after removal of the handle 30) by prying between the interior face 12 of jamb 14 and the flange 74 which rings the escutcheon 68, overcoming the frictional forces introduced by the springs 102 otherwise retaining the escutcheon 68 in the jamb cavity 84.

Figure 8:
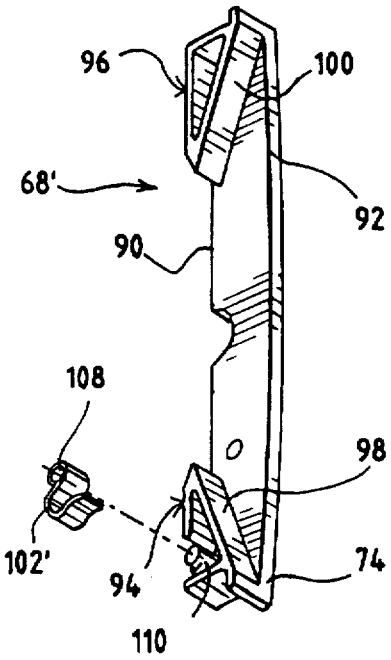
FIG. 8 is an exploded perspective view of an escutcheon and springs according to another embodiment of one aspect of the present invention.
Figure 8A:
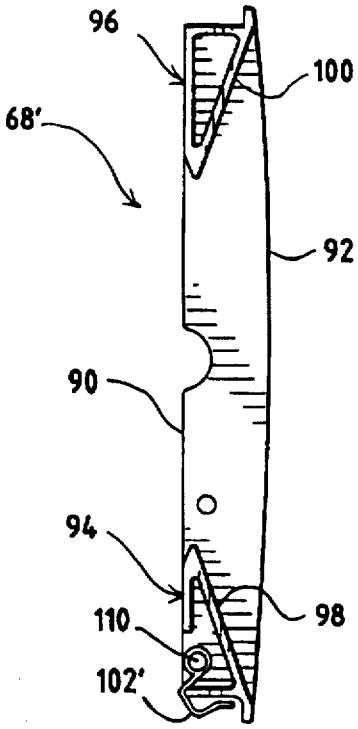
FIG. 8A is a side view of the FIG. 8 embodiment.

In a second preferred embodiment shown in FIGS. 8 and 8A, the escutcheon 68' is held in place with a single spring 102' (such as previously described). This generally U-shaped spring 102' includes a cylindrical portion 108 on one side, and the escutcheon 68' includes a post 110 over which the cylindrical portion 108 may be mounted. When the escutcheon is pressed into the jamb cavity 84, the U-shaped spring 102' compresses against the one side of the cavity 84, thereby not only frictionally engaging that side but also biasing the escutcheon 68' into frictional engagement with the other side of the cavity 84 to secure it therein. Again, this escutcheon may thereafter be easily removed.

In operation, the mating surfaces of the handle 30 and escutcheon 68 conceal the tie bar 32 and link assembly 28 from sight. Only parts of the handle 30 and escutcheon 68 are visible from the interior of the dwelling. The less visible hardware allows the beauty of the wood or vinyl wrapped window to be highlighted. Further, the detachability of both the handle 30 and the escutcheon 68 allow the window jamb 14 to be painted or stained without having to work around or cover up the hardware. Easy color changes or upgrades can be performed with easy installation, since no screw removal is required. The detachable handle 30 also provides less danger of the handle being disabled during shipping, and also provides a reduction in shipping damage caused by the handle rubbing, scratching or gouging neighboring windows on the transport vehicle, since the handle 30 need not be attached to the window unit until the unit is in place. Still other aspects, objects and advantages of the present invention can be obtained from a study of the specification, the drawings and the appended claims.

We claim:

1. A window lock actuator for selectively locking a window sash closed against a window jamb by selectively engaging a first member secured to the jamb, said first member including at least one tab extending from an edge of said first member, with a second member secured to the sash when the sash is substantially closed against the jamb, the window lock actuator comprising:

an escutcheon mountable inside a cavity in said window jamb;

a link assembly rotatably mountable on said window jamb adjacent said escutcheon, said link assembly operably securable to the first member to control movement of the first member into and out of engagement with the second member; and a handle detachably secured to said link assembly for rotation therewith; and means attachable to the first member for blocking light incoming through said cavity, including an elongated member having a front wall and two sidewalls defining a channel, at least one pair of opposing tabs formed on opposing inner surfaces of said sidewalls in said channel, and a fin disposed at a distal end of said channel, said fin having opposing generally flat surfaces, wherein said at least one tab and said at least one pair of opposing tabs engage when said light guard means is secured to said first member.

2. A window lock for selectively locking a window sash closed against a window jamb, the window lock comprising:

a first keeper securable to the window sash;

a first cam securable to the window jamb;

means for axially moving said first cam to selectively engage said first keeper when the sash is substantially closed against the jamb;

a link assembly rotatably mountable on said window jamb, said link assembly operably securable to said moving means to control movement of said first cam into and out of engagement with said first keeper;

a handle secured to said link assembly for rotation therewith;

two legs defining a fork at a distal end of said handle, said two leg of said handle cradling said link assembly when said handle is secured thereto;

two tabs on said link assembly and two recesses on opposite inner surfaces of said legs, wherein the two tabs and the two recesses engage to detachably and reattachably secure said handle to said link assembly, an escutcheon detachably mountable to said window jamb adjacent said link assembly inside a cavity in said window jamb, said handle being pivotally disposed in said escutcheon;

a second keeper securable to the window sash; and a second cam securable to the window jamb, said moving means interconnecting said first and second cams, wherein said cavity is disposed between said first and second keepers when said keepers are secured to the window sash.

3. The window lock of claim 3, wherein said moving means comprises a tie bar.

4. A window lock for selectively locking a window sash closed against a window jamb, the window lock comprising:

a first keeper securable to the window sash;

a first cam securable to the window jamb and including at least one tab extending from an edge of said first cam;

means for axially moving said first cam to selectively engage said first keeper when the sash is substantially closed against the jamb;

a link assembly rotatably mountable on said window jamb, said link assembly operably securable to said moving means to control movement of said first cam into and out of engagement with said first keeper;

a handle having two legs defining a fork at a distal end of said handle, said two legs of said handle cradling said link assembly when said handle is secured thereto;

two tabs on said link assembly and two recesses on opposite inner surfaces of said legs, wherein the two tabs and the two recesses engage to detachably secure said handle to said link assembly for rotation therewith;

an escutcheon mountable inside a cavity in said window jamb adjacent said link assemble; and light guard means attached to said first cam for blocking light incoming through said cavity including an elongated member having a front wall and two sidewalls defining a channel;

at least one pair of opposing tabs formed on opposing inner surfaces of said sidewalls in said channel; and a fin disposed at a distal end of said channel, said fin having opposing generally flat surfaces, wherein said at least one tab and said at least one pair of opposing tabs engage when said light guard means is secured to said first cam.

5. In a window lock having a first keeper securable to a window sash, a first cam securable to a tie bar which is guidably mounted to said window jamb for axial movement to selectively engage or disengage the first cam with the first keeper to selectively lock or release the sash from the jamb, a link to control movement of said tie bar, and a handle secured to said link for rotation therewith, the improvement comprising:

an escutcheon locatable in a cavity defined by said window jamb and including a flat, elongated body;

a pair of spaced surfaces extending generally perpendicular from a side of said body, said surfaces extending across substantially the width of the jamb cavity when said escutcheon is located in said cavity and having an angular orientation relative to one another substantially defining the range of rotation of a handle used with said escutcheon, and means for securing said spring to one side of said body; and a spring on one end said escutcheon biasing against a side of said cavity when said escutcheon is located in said cavity.

* * * * *